US008756986B2

(12) United States Patent
Jessen et al.

(10) Patent No.: US 8,756,986 B2
(45) Date of Patent: Jun. 24, 2014

(54) METHOD FOR OPERATING AN INTERNAL COMBUSTION ENGINE

(71) Applicants: Holger Jessen, Ludwigsburg (DE); Wolfgang Tiebel, Stuttgart (DE)

(72) Inventors: Holger Jessen, Ludwigsburg (DE); Wolfgang Tiebel, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/672,267

(22) Filed: Nov. 8, 2012

(65) Prior Publication Data

US 2013/0118243 A1 May 16, 2013

(30) Foreign Application Priority Data

Nov. 11, 2011 (DE) ..... 10 2011 086 150

(51) Int. Cl.
*F02M 65/00* (2006.01)

(52) U.S. Cl.
USPC ..... 73/114.45

(58) Field of Classification Search
USPC ..... 73/114.02, 114.45
See application file for complete search history.

(56) References Cited

U.S. PATENT DOCUMENTS

| | | | | |
|---|---|---|---|---|
| 6,032,659 | A * | 3/2000 | Yamashita et al. | 123/674 |
| 6,457,455 | B2 * | 10/2002 | Baeuerle et al. | 123/406.24 |
| 6,584,834 | B1 * | 7/2003 | Lehner et al. | 73/114.08 |
| 7,051,725 | B2 * | 5/2006 | Ikemoto et al. | 123/673 |
| 7,195,008 | B2 * | 3/2007 | Annoura et al. | 123/674 |
| 7,703,437 | B2 * | 4/2010 | Scheffler et al. | 123/406.14 |
| 7,721,711 | B2 * | 5/2010 | Kurosawa et al. | 123/434 |
| 7,933,710 | B2 * | 4/2011 | Tanaka et al. | 701/103 |
| 2001/0020465 | A1 * | 9/2001 | Baeuerle et al. | 123/406.23 |
| 2005/0022797 | A1 * | 2/2005 | Ikemoto et al. | 123/673 |
| 2009/0037083 | A1 * | 2/2009 | Scheffler et al. | 701/104 |

FOREIGN PATENT DOCUMENTS

| | | |
|---|---|---|
| DE | 100 01 274 | 7/2001 |
| DE | 10 2006 026 390 | 12/2007 |

* cited by examiner

*Primary Examiner* — Freddie Kirkland, III
(74) *Attorney, Agent, or Firm* — Kenyon & Kenyon LLP

(57) ABSTRACT

In a method for operating an internal combustion engine having multiple cylinders, a cylinder to be checked is diagnosed for an injection quantity error. During a normal operation, a first air/fuel ratio is predefined for the multiple cylinders, and a first uneven running is ascertained. During an adjustment operation, a second air/fuel ratio for the cylinder to be checked is predefined during a number of working cycles. During the adjustment operation, a second uneven running is ascertained. The injection quantity error is ascertained for the cylinder to be checked as a function of the first uneven running and the second uneven running.

15 Claims, 7 Drawing Sheets

METHOD FOR OPERATING AN INTERNAL COMBUSTION ENGINE

BACKGROUND OF THE INVENTION

1. Field of the Invention

The present invention relates to a method for operating an internal combustion engine.

2. Description of Related Art

Methods are known in which individual cylinders of an internal combustion engine are diagnosed for an injection quantity error.

It is furthermore known that the legal requirements are increasing for the diagnosis of injection quantity errors or for the detection of inequalities in the air/fuel ratio of the cylinders to reduce the exhaust emissions.

A method for misfire detection and cylinder balancing in internal combustion engines having knock control is known from published German patent application document DE 100 01 274 A1. Uneven running values are ascertained and compared to a threshold value. The correction factors are ascertained based on the deviation.

An electronic control unit for controlling the internal combustion engine, the control unit having an uneven running ascertainment unit and an injection quantity correction unit, is known from published German patent application document DE 10 2006 026 390 A1. An injection quantity of a cylinder to be checked is adjusted toward "lean" in a ramp-like manner until a predefined uneven running differential value is reached. Individual differential adjustment values are successively ascertained for every cylinder, and in the presence of all differential adjustment values, a particular cylinder-individual correction value is ascertained and stored as a function of all differential adjustment values. Subsequently, the injection quantity may be corrected in a cylinder-individual manner.

BRIEF SUMMARY OF THE INVENTION

The method according to the present invention makes it possible to ascertain the injection quantity error for a cylinder to be checked within a relatively short amount of time, i.e., within a few working cycles. The short period of time needed to ascertain the injection quantity error advantageously reduces the susceptibility of the ascertainment to interferences, e.g., poor road, rotational speed change or acceleration. Poor road is understood to mean roadway bumps which may affect the ascertainment of the injection quantity error through uneven running. Overall, this thus results in a fast ascertainment of the injection quantity error which is less susceptible to interferences. These advantages may also be used to ascertain a corresponding correction value.

In one advantageous specific embodiment of the method, the injection quantity error is ascertained for the cylinder to be checked with the aid of a previously ascertained characteristic curve as a function of an ascertained change in uneven running. The previously ascertained characteristic curve, which was ascertained during the application phase, advantageously links the ratio between two dynamic variables, the first and the second uneven runnings, in the sense of the ascertained change in uneven running to the injection quantity error. Ascertaining the injection quantity error with the aid of the previously ascertained characteristic curve thus contributes to the method being carried out fast.

In one advantageous specific embodiment of the method, the second air/fuel ratio is ascertained in an essentially fixed ratio to the particular first air/fuel ratio. Furthermore, the second air/fuel ratio has a lower fuel content than the first air/fuel ratio for the cylinder to be checked. In this way, the second air/fuel ratio is easily determined in such a way that changes in uneven running result which originate from the cylinder to be checked, whereby the injection quantity error may be deduced for the cylinder to be checked. By estimating a fixed ratio for the cylinder to be checked in the sense of an essentially constant parameter between the second air/fuel ratio during the adjustment operation and the first air/fuel ratio during the normal operation carried out previously, for example, a reaction as a function thereof may be expected in the rotation behavior of the crankshaft of the internal combustion engine in the sense of the second uneven running and made use of to ascertain the injection quantity error.

In one advantageous specific embodiment of the method, a third air/fuel ratio is predefined for at least one of the other cylinders during the adjustment operation. The third air/fuel ratio is ascertained in another, essentially fixed ratio to the particular first air/fuel ratio for the at least one of the other cylinders. The third air/fuel ratio has a higher fuel content than the particular first air/fuel ratio. In this way, a balance for the lean-adjusted cylinder to be checked is achieved with regard to maintaining the desired operating point, e.g., with regard to the rotational speed and/or the torque.

In one advantageous specific embodiment of the method, multiple uneven running values are ascertained during the adjustment operation within a time period of the number of working cycles. The second uneven running is ascertained as an averaged value from the multiple uneven running values. Thus, the susceptibility to interferences, e.g., poor road, rotational speed change, or acceleration, is advantageously reduced.

In another advantageous specific embodiment of the method, the normal operation, the adjustment operation, and the ascertainment of the injection quantity error are carried out at least once for every cylinder as the cylinder to be checked. The method thus allows all cylinders to be checked rapidly one after another. The injection quantity error of the cylinder to be checked is advantageously available already after carrying out the normal operation and the adjustment operation for the first time.

In another advantageous specific embodiment, an engine characteristic map having multiple previously ascertained characteristic curves for different operating states of the internal combustion engine is available. As a function of the instantaneous operating state, one of the multiple characteristic curves is selected and the injection quantity error is ascertained for the cylinder to be checked with the aid of the selected characteristic curve as a function of the ascertained change in uneven running. On the one hand, this allows many operating states to be used for the ascertainment of the injection quantity error, thus considerably reducing the time until the presence of the injection quantity error. On the other hand, the accuracy of the ascertainment of the injection quantity error is improved.

In one particularly advantageous specific embodiment of the method, a pre-enrichment of the particular air/fuel mixture takes place during the normal operation and the adjustment operation. In this way, it is advantageously achieved that in a range of the characteristic curve, which, without pre-enrichment, has a small change in uneven running, a greater change in uneven running is produced, which makes it possible to deduce the injection quantity error more precisely.

In another advantageous specific embodiment of the method, an error is ascertained for the cylinder to be checked when the ascertained change in uneven running is below a lean error threshold or above a rich error threshold. In this way, it is advantageously achieved that injection quantity errors which can no longer be tolerated are detected and signaled as errors. Such an error may, for example, be displayed in the vehicle to signal to the driver that she/he should immediately drive to the next repair shop.

In one particularly advantageous specific embodiment, a correction value is ascertained for the cylinder to be checked as a function of the ascertained injection quantity error, and the first air/fuel ratio for the cylinder to be checked is ascertained as a function of the ascertained correction value. A cylinder which is erroneous with regard to the air/fuel ratio may thus be operated advantageously already after the completion of a diagnosis taking into account the ascertained correction value, whereby the exhaust gas values improve immediately, since the combustion properties of the now corrected first air/fuel ratio are improved.

In one particularly advantageous refinement, the correction value for the cylinder to be checked is adapted as a function of the previously ascertained correction values for the cylinder to be checked. In this way, a continuous improvement of the correction value may be achieved.

In one advantageous refinement of the method, a correction value is ascertained for every cylinder and a balanced correction value is ascertained from the product of the correction value having the quotient from the number of cylinders and the sum of all correction values for all cylinders. It is thus advantageously achieved that the overall injection quantity remains essentially the same for all cylinders.

Additional features, possible applications, and advantages of the present invention are derived from the following description of exemplary embodiments of the present invention, which are illustrated in the figures of the drawing. All features described or illustrated represent the subject matter of the present invention alone or in any desired combination, regardless of their recapitulation in the patent claims or their back-references, and regardless of their wording in the description or illustration in the drawing. The same reference numerals are used for functionally equivalent variables in all figures, even in different specific embodiments.

DETAILED DESCRIPTION OF THE INVENTION

Figure 1A:
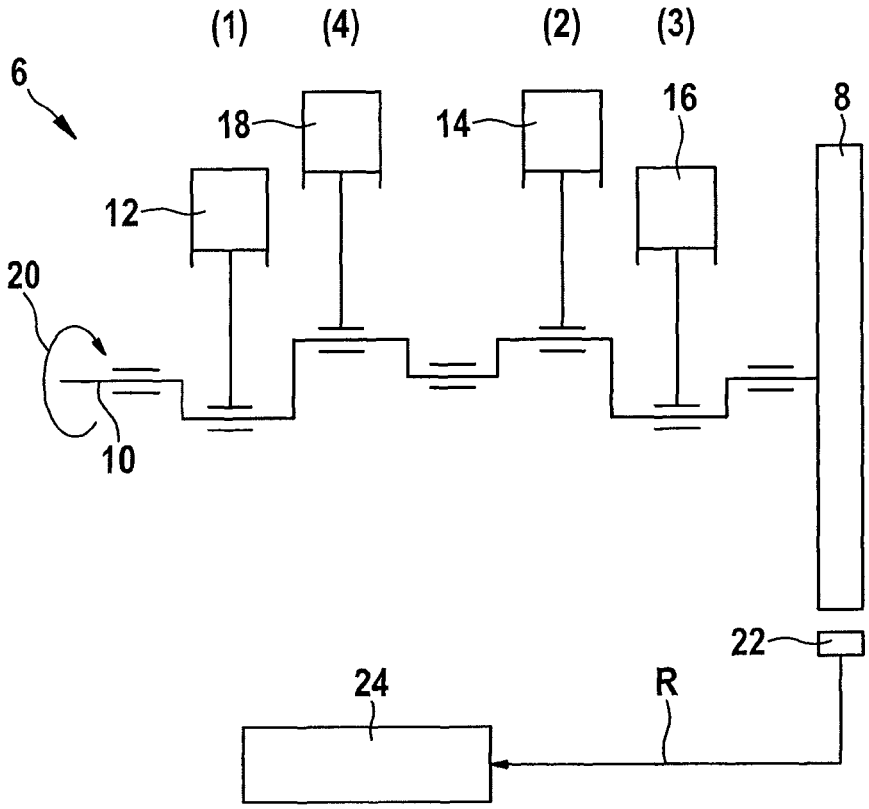
FIG. 1*a* shows a schematically illustrated internal combustion engine having a sensor wheel.

FIG. 1*a* shows a schematically illustrated internal combustion engine 6 having a sensor wheel 8, sensor wheel 8 being shown in a lateral view. Internal combustion engine 6 includes a crankshaft 10 having pistons 12, 14, 16, and 18 installed at crankshaft 10. Pistons 12, 14, 16, and 18 are each assigned to a cylinder which is identified by 1, 2, 3, and 4 according to the ignition sequence of internal combustion engine 6. Crankshaft 10 rotates in a direction of rotation 20. The number of cylinders is identified by n, n=4 in the present example. A certain cylinder is identified by i, i=1, 2, 3, 4 in the present example.

Sensor wheel 8 is fixedly connected to crankshaft 10. Sensor wheel 8 includes a tooth pattern which is situated along the periphery of sensor wheel 8. A crankshaft sensor 22 detects the angular position of crankshaft 10 via the tooth pattern of sensor wheel 8. According to the angular position of sensor wheel 8, crankshaft sensor 22 generates a crankshaft signal R. Crankshaft signal R is supplied to a control unit 24. Control unit 24 supplies individual control signals to actuators (not shown), such as injectors of individual cylinders 1 through 4.

Figure 1B:
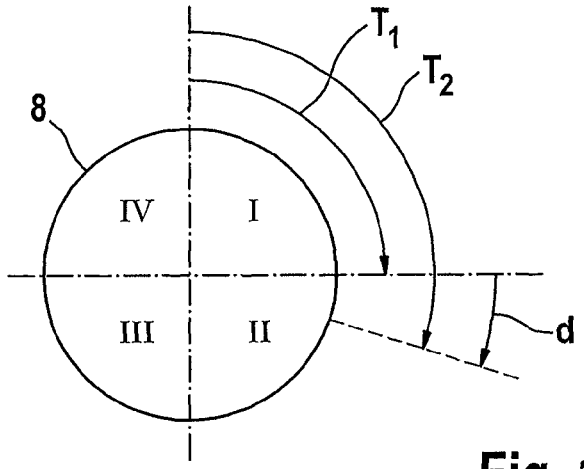
FIG. 1*b* schematically shows the sensor wheel.

FIG. 1*b* schematically shows sensor wheel 8 in a top view. Sensor wheel 8 is subdivided into four segments, as an example, according to quadrants I, II, III and IV which may be assigned to individual cylinders i. Each segment is passed twice during one working cycle of crankshaft 10. For the first segment according to quadrant I, a first segment time $T_1$ is plotted. Furthermore, a second segment time $T_2$ and a segment time deviation d are plotted. Segment time deviation d results from the difference between second segment time $T_2$ and first segment time $T_1$. If a first segment time $T_1$ is greater than second segment time $T_2$, a correspondingly negative segment time deviation results.

First segment time $T_1$ may, for example, correspond to a setpoint segment time, and second segment time $T_2$ to a measured segment time. In another specific embodiment, first and second segment times $T_1$ and $T_2$ are measured segment times. Segment time deviation d represents an uneven running of crankshaft 10. Alternatively, crankshaft signal R may be converted by control unit 24 into a crankshaft angular speed, and the uneven running may be ascertained by comparing the crankshaft angular speeds of successive working cycles. Or, the uneven running of crankshaft 10 is ascertained from a difference between an instantaneous crankshaft angular speed and an averaged crankshaft angular speed. Uneven running is basically understood to mean the deviation of two measured variables, the two variables depending in a different way on a rotary motion of the internal combustion engine, in particular the crankshaft. Thus, other methods for ascertaining the uneven running may of course also be used.

Figure 2:
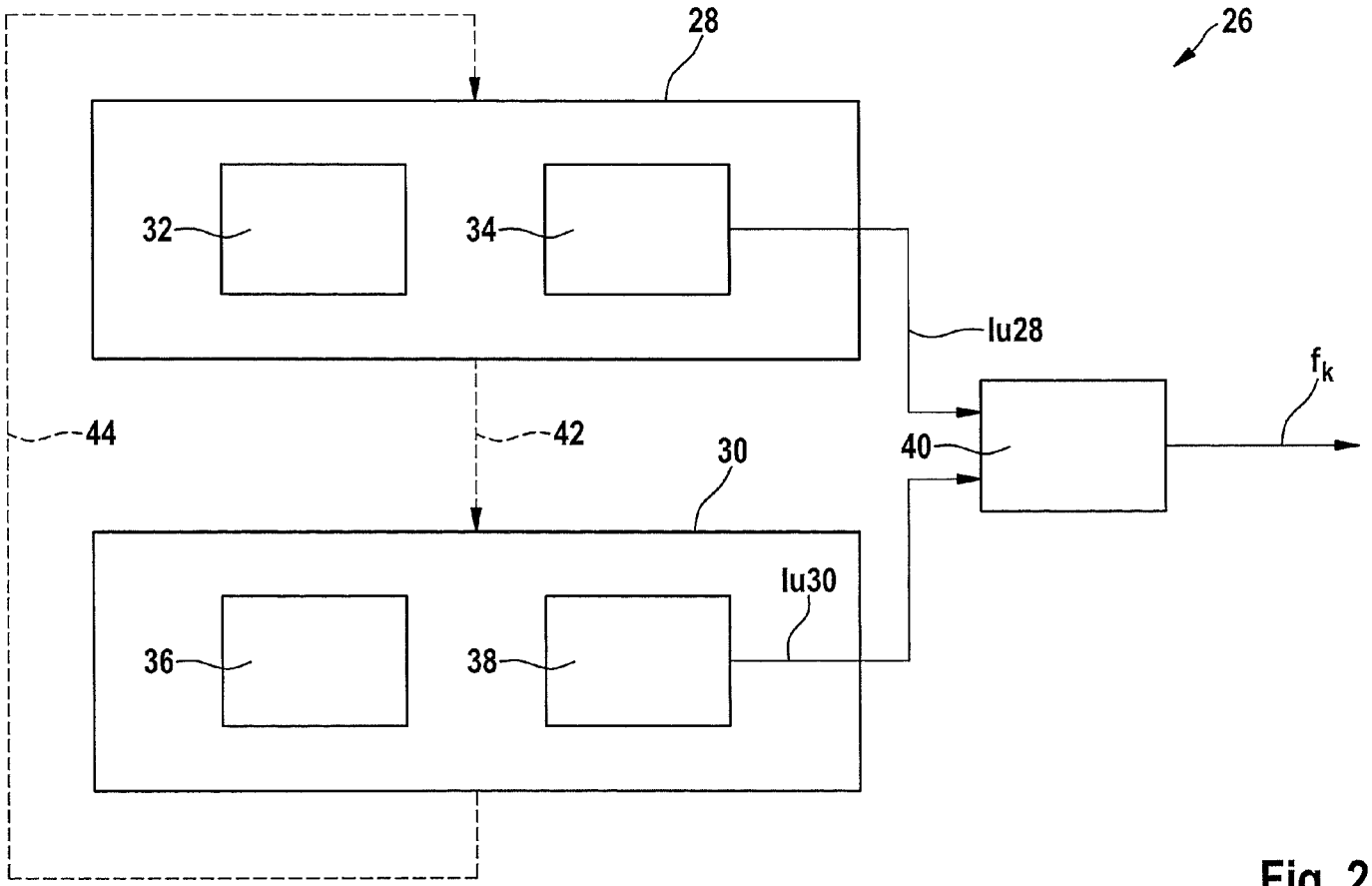
FIG. 2 shows a schematic block diagram for carrying out a normal operation and an adjustment operation.
Figure 3:
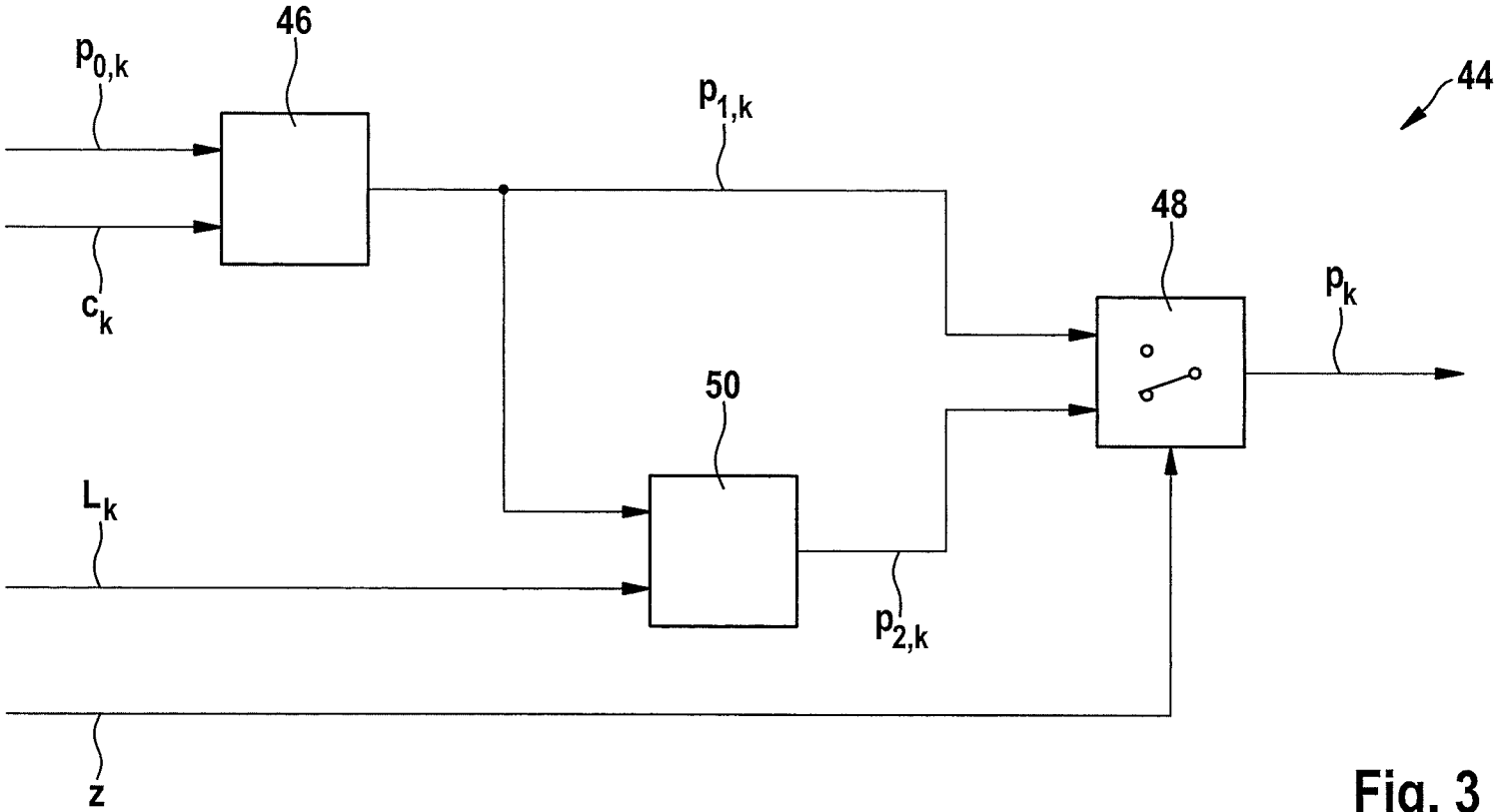
FIG. 3 shows a schematic block diagram for ascertaining an air/fuel ratio to be predefined for a cylinder to be checked.
Figure 4:
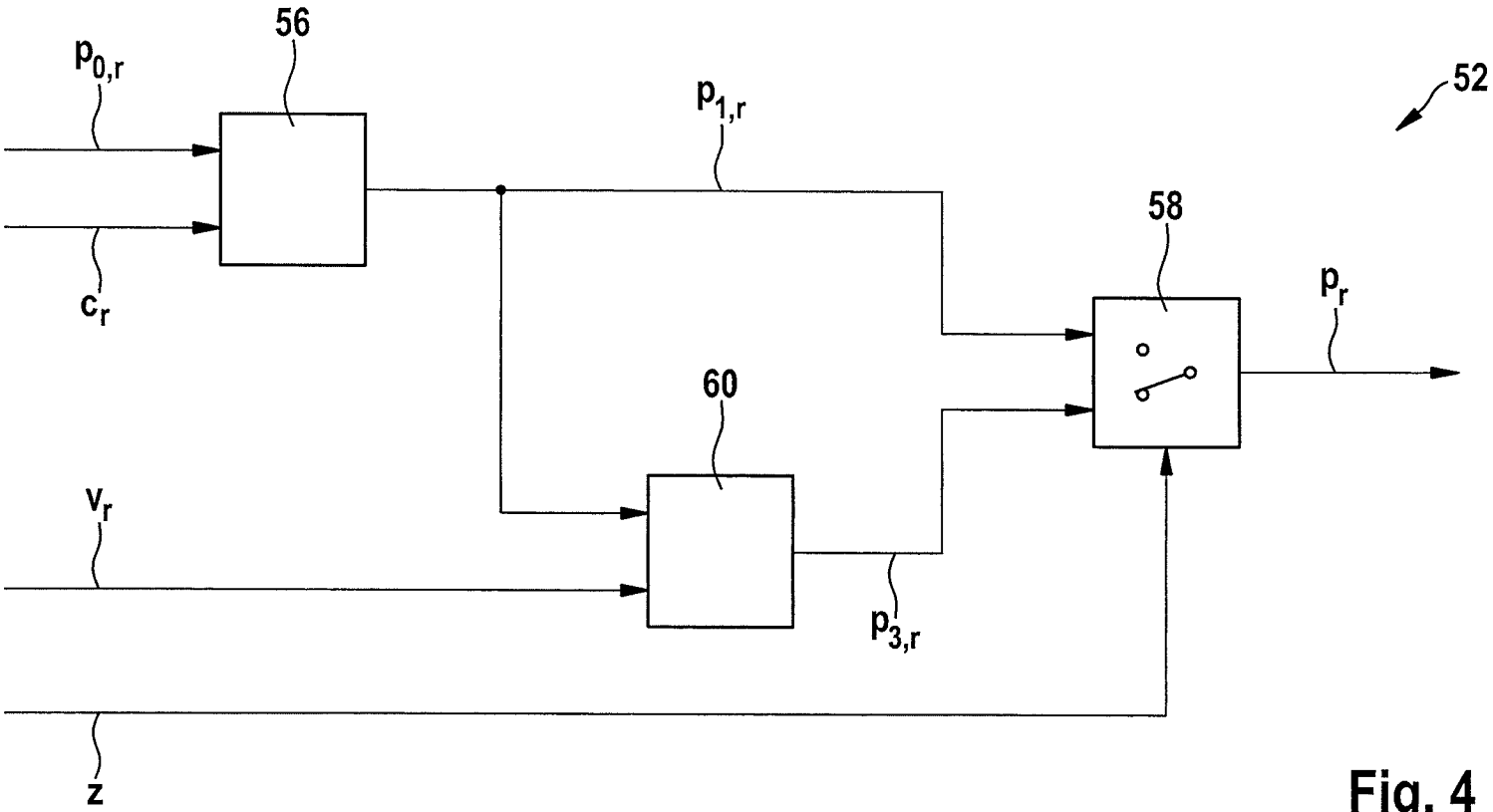
FIG. 4 shows a schematic block diagram for ascertaining an air/fuel ratio to be predefined for a different cylinder than the one to be checked.

FIG. 2 shows a schematic block diagram 26 for carrying out a normal operation 28 and an adjustment operation 30. During normal operation 28, a first air/fuel ratio, which is explained in greater detail with reference to FIGS. 3 and 4, is predefined specifically to every cylinder according to block 32. This means that the first air/fuel ratios may be different for cylinders i. In an evaluation block 34, a first uneven running lu28 is ascertained during normal operation 28.

During adjustment operation 30, a second air/fuel ratio, which is explained in greater detail with reference to FIG. 3, is predefined for a cylinder k to be checked, k corresponding to one of cylinders 1, 2, 3 or 4 explained in FIG. 1 by a block 36 during a number s of working cycles. Furthermore, a third air/fuel ratio, which is explained in greater detail with reference to FIG. 4, may be predefined for at least one other cylinder i as cylinder k to be checked by block 36. An evaluation block 38 generates a second uneven running lu30 which is supplied to another evaluation block 40. Cylinder k to be checked is diagnosed for an injection quantity error $f_k$, injection quantity error $f_k$ being ascertained by further evaluation block 40. Further evaluation block 40 is supplied with first uneven running lu28 in addition to second uneven running lu30. Further evaluation block 40 ascertains injection quantity error $f_k$ for cylinder k to be checked as a function of first uneven running lu28 and second uneven running lu30. Injection quantity error $f_k$ is preferably ascertained from uneven runnings lu28 and lu30 ascertained in real time. Alternatively or additionally to injection quantity error $f_k$, further evaluation block 40 may generate a correction value, which is explained in greater detail with reference to FIGS. 3 and 4.

Redefining an air/fuel ratio by control unit 24 from FIG. 1*a* is understood to mean predefining a fuel quantity to be injected and/or predefining an injection duration, in particular predefining a starting point in time of the injection and an ending point in time of the injection. The air/fuel ratio also includes the property of a proportional composition of fuel and air combined in cylinder i. Cylinder k to be checked is selected from total number n of present cylinders i. Another cylinder or the other cylinders, which do not correspond to cylinder k to be checked, is/are identified by reference symbol r.

A diagnosis is understood to mean the ascertainment of the two uneven runnings lu28 and lu30 as well as the ascertainment of injection quantity error $f_k$ for cylinder k to be checked and/or the ascertainment of the correction factor for cylinder k to be checked. This means that a diagnosis always refers to a cylinder k to be checked. According to arrow 42, the operation is switched from normal operation 28 to adjustment operation 30. According to an arrow 44, the operation is switched from adjustment operation 30 to normal operation 28. The chronological sequence of normal operation 28 and adjustment operation 30 is of course inessential for the ascertainment of uneven running dlu. To start the diagnosis, there are, among other things, the options explained below. In one first specific embodiment, the diagnosis is carried out once per trip for each present cylinder i as cylinder k to be checked. In another specific embodiment, the diagnosis is to be started and carried out in regular intervals. If, for example, the operating parameters do not allow the planned diagnosis to be carried out, it is awaited until the operating parameters allow the diagnosis to be started and the diagnosis is started as soon as possible. In another specific embodiment, the diagnosis is started when another function, which is not explained in greater detail, starts the diagnosis, the function, which is not explained in greater detail, being "suspicious" of a disadvantageous deviation of injection quantity error $f_k$ due to the exceedance of a limiting value by an operating parameter, for example. The above-mentioned specific embodiments for starting the diagnosis may of course be present side by side.

After starting adjustment operation 30, the second air/fuel ratio for cylinder k to be checked is preferably initially predefined. This means that cylinder k to be checked is preferably initially activated at another than the first air/fuel ratio, and other cylinders r are subsequently activated at the third air/fuel ratio during adjustment operation 30.

During adjustment operation 30, the air/fuel ratios for individual cylinders i are predefined according to block 36 for number s of working cycles. Only after a certain number of working cycles following the start of adjustment operation 30, e.g., three to four, in which block 36 has predefined the particular air/fuel ratio of adjustment operation 30 for individual cylinders i, does the observation and evaluation of the uneven running values of the crankshaft start in evaluation block 38 for another number of working cycles, e.g., 5 to 20, as well as the ascertainment of second uneven running lu30. During normal operation 28, the observation and evaluation of the uneven running values as well as the ascertainment of first uneven running lu28 preferably takes place in evaluation block 34 for an essentially identical number of working cycles, e.g., 5 to 20. First uneven running lu28 may of course also be ascertained in a different manner. First and second uneven runnings lu28 and lu30 are preferably ascertained in real time in order to allow the ascertainment to take place under essentially identical operating conditions.

After the completion of adjustment operation 30, the operation is switched back to normal operation 28 according to arrow 44. Back in normal operation 28, it is now possible to select another cylinder i as cylinder k to be checked in the context of another diagnosis. Normal operation 28, adjustment operation 30, and the ascertainment of injection quantity error $f_i$ are all carried out at least once for every cylinder i as cylinder k to be checked, thus making it possible for an injection quantity error $f_i$ to be ascertained for each cylinder i.

FIG. 3 shows a schematic block diagram 44 for ascertaining an air/fuel ratio $p_k$ to be predefined for cylinder k to be checked. A pre-calculated air/fuel ratio $p_m$, is supplied to a block 46. Furthermore, a correction value $c_k$ is supplied to block 46. Block 46 generates first air/fuel ratio $p_{1,k}$ as a function of pre-calculated air/fuel ratio $p_{0,k}$ and correction value $c_k$. Correction value $c_k$ is preferably formed as a factor which yields a corrected injection quantity of the fuel of first air/fuel ratio $p_{1,k}$ when multiplied by a fuel injection quantity of pre-calculated air/fuel ratio $p_{0,k}$. Correction value $c_k$ is set to one in the beginning. If correction value $c_k$ changes during operation, correction factor $c_k$ may be stored in a memory of control unit 24 for a next start of internal combustion engine 6. Correction factor $c_k$ may of course also be ascertained in a different manner and refer to another variable of previously ascertained air/fuel ratio $p_{0,k}$ or another air/fuel ratio. First air/fuel ratio $p_{1,k}$ is supplied to a switch 48 and a block 50.

A leaning value $L_k$ is supplied to block 50. As a function of first air/fuel ratio $p_{1,k}$ and leaning value $L_k$, second air/fuel ratio $p_{2,k}$ is generated by block 50. Leaning value $L_k$ refers to first air/fuel ratio $p_{1,k}$ as the basic value and may, for example, be indicated in percent or as a factor. Leaning value $L_k$ is selected in such a way that second air/fuel ratio $p_{2,k}$ has a smaller fuel content than first air/fuel ratio $p_{1,k}$ for cylinder k to be checked, the transition from first air/fuel ratio $p_{1,k}$ to second air/fuel ratio $p_{2,k}$ corresponding to a leaning. An increase in the fuel content corresponds to an enrichment. Leaning value $L_k$ is essentially kept constant while adjustment operation 30 is carried out, which is why second air/fuel ratio $p_{2,k}$ is ascertained in an essentially fixed ratio to particular first air/fuel ratio $p_{1,k}$.

The switching state of switch 48 is influenced as a function of a signal z. Depending on the switching state of switch 48, the functionality of block 32 or block 36 from FIG. 2 is carried out. In FIG. 3, the function of block 36 is shown and second air/fuel ratio $p_{2,k}$ is transferred to cylinder k to be checked as air/fuel ratio $p_k$ to be predefined, or second air/fuel ratio $p_{2,k}$ is predefined for cylinder k to be checked. The switching position of switch 48 (not shown in FIG. 3) corresponds to the functionality of block 32 from FIG. 2, first air/fuel ratio $p_{1,k}$ being predefined for cylinder k to be checked as air/fuel ratio $p_k$ to be predefined.

FIG. 4 shows a schematic block diagram 52 for ascertaining an air/fuel ratio $p_r$ to be predefined for another cylinder r which is not cylinder k to be checked. Block diagram 52 shown in FIG. 4 is preferably carried out for each of the other cylinders r, however, at least for one of the other cylinders r. For example, cylinder k to be checked equals 2 and the other cylinders r equal 1, 3, and 4. Cylinder-individual, pre-calculated air/fuel ratio $p_{0,r}$ is supplied to a block 56. Furthermore, a correction value $c_r$ is supplied to block 56, correction value $c_r$ being generally referred to as correction value $c_i$ together with correction value $c_k$. Block 56 generates a first air/fuel ratio $p_{1,r}$, which is supplied to a switch 58 and a block 60. Block 60 generates third air/fuel ratio $p_{3,k}$ from first air fuel ratio $p_{1,r}$ and an enrichment value $v_r$. As a function of signal z, switch 58 selects first air/fuel ratio $p_{1,r}$ or third air/fuel ratio $p_{3,r}$ to be transferred as air/fuel ratio $p_r$ to be predefined for at least one other cylinder r. In FIG. 4, as in FIG. 3, the state of switch 58 is selected in such a way that adjustment operation 30 is carried out.

Block diagram 52 of FIG. 4 essentially differs from block diagram 44 of FIG. 3 in that instead of leaning value $L_k$ in FIG. 3, enrichment value $v_r$ is supplied to block 60 in FIG. 4. Due to enrichment value $v_r$ which represents a ratio between first air/fuel ratio $p_{1,r}$ and third air/fuel ratio $p_{3,r}$, third air/fuel ratio $p_{3,r}$ is ascertained in such a way that third air/fuel ratio $p_{3,r}$ has a higher fuel content than particular first air/fuel ratio $p_{1,r}$. Enrichment value $v_r$ remains essentially constant, at least during adjustment operation 30. During adjustment operation 30, third air/fuel ratio $p_{3,r}$ is predefined as air/fuel ratio $p_r$ to be predefined for at least one of the other cylinders r with the aid of switch 58.

Leaning value $L_k$ for cylinder k to be checked and enrichment value $v_r$ for the remaining cylinder(s) r are preferably determined contingent upon each other. For example, enrichment values $v_r$ may be predefined for all remaining cylinders r in such a way that the effects of leaning value $L_k$ for cylinder k to be checked are compensated for or at least reduced when the operation is switched from normal operation 28 to adjustment operation 30, e.g., with regard to the torque behavior and/or the rotational speed and/or the lambda value with regard to a clean combustion. In this way, adjustment operation 30 may be carried out in such a way that the driving behavior of the vehicle and/or the exhaust gas behavior of internal combustion engine 6, for example, is/are essentially not changed at all.

Leaning value $L_k$ and enrichment value $v_r$ for adjustment operation 30 may be selected as a function of the operating conditions, e.g., the rotational speed and/or the load.

Furthermore, leaning value $L_k$ and enrichment value $v_r$ may be selected as a function of the type of internal combustion engine 6 and/or as a function of particular cylinder k or r. Furthermore, certain operating conditions may be established which result in an immediate termination of the diagnosis which was just carried out or in a subsequent rejection of ascertained results.

Figure 5:
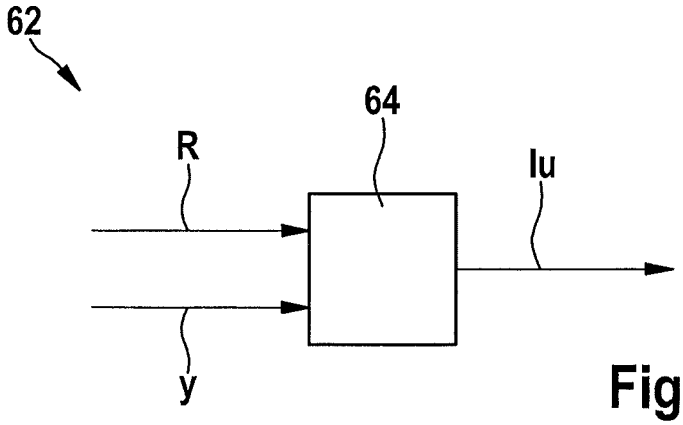
FIG. 5 shows a schematic block diagram for ascertaining an uneven running.

FIG. 5 shows a schematic block diagram 62 for ascertaining an uneven running lu, the uneven running possibly being first or second uneven running lu28 or lu30. A block 64 generates uneven running lu as a function of crankshaft signal R and a signal y. For this purpose, block 64 may use one of the methods explained based on FIG. 1*b*, for example. Signal y indicates the start and the end of the time period to be observed. In the case of the ascertainment of second uneven running lu30, block 64 may, for example, ascertain multiple uneven running values from crankshaft signal R within a time period of number s of working cycles during adjustment operation 30, second uneven running lu30 being ascertained as an averaged value from the multiple uneven running values. As explained above with regard to FIG. 2, it is also possible to provide only one selected time period from number s of working cycles, in the sense of the time period explained above, during adjustment operation 30 for ascertaining second uneven running lu30. After the time period to be observed has elapsed, signaled by signal y, uneven running lu is made available by block 64.

Figure 6:
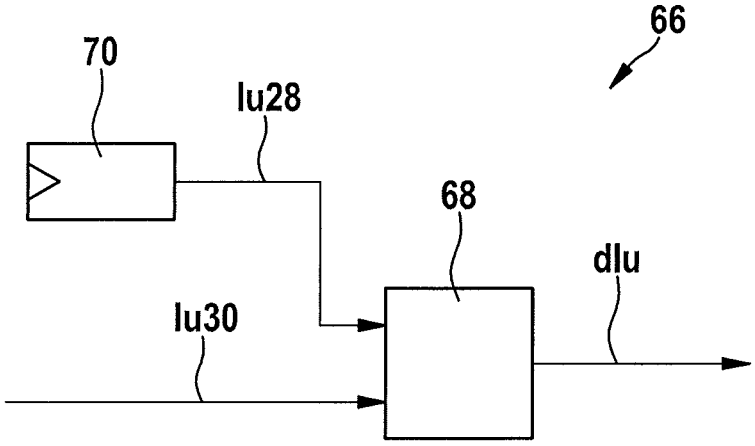
FIG. 6 shows a schematic block diagram for ascertaining a change in uneven running.

FIG. 6 shows a schematic block diagram 66 for ascertaining a change in uneven running dlu. Change in uneven running dlu is ascertained with the aid of a block 68 from first uneven running lu28 and second uneven running lu30. To ascertain the change in uneven running dlu, the presence of both uneven runnings lu28 and lu30 must be awaited, first uneven running lu28 being stored in an intermediate memory 70 in the example shown. First uneven running lu28 is, for example, stored in intermediate memory 70 during or after completion of normal operation 28. Block diagram 66 corresponds, as an example, to a part of the functionality of block 40 from FIG. 2. The change in uneven running dlu may, for example, be indicated in percent, having first uneven running lu28 as a reference basis, as a corresponding factor, as an absolute difference, or in any other form.

Figure 7:
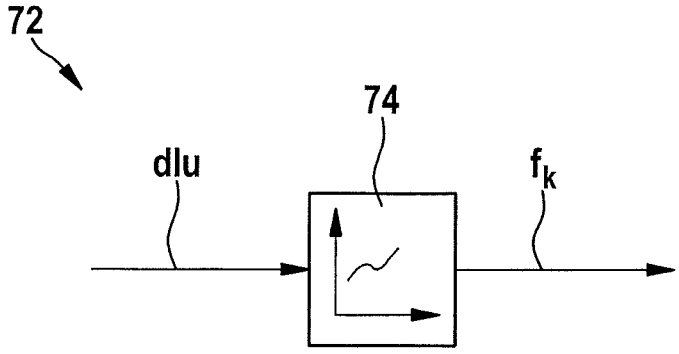
FIG. 7 shows a schematic block diagram for ascertaining an injection quantity error.

FIG. 7 shows a schematic block diagram 72 for ascertaining injection quantity error $f_k$. Injection quantity error $f_k$ is ascertained for cylinder k to be checked with the aid of a previously ascertained characteristic curve 74 as a function of the ascertained change in uneven running dlu. Here, characteristic curve 74 is used for all cylinders i. Alternatively, an individual characteristic curve 74 may be present for each individual cylinder i, thus making it possible to take into account the cylinder-individual properties and improving the accuracy of the diagnosis and the correction. Characteristic curve 74 is ascertained during the application phase when internal combustion engine 6 works essentially error-free and is stored in control unit 24 of internal combustion engine 6. Characteristic curve 74 is explained in greater detail based on FIG. 9.

Correction value $c_k$ is ascertained for cylinder k to be checked as a function of ascertained injection quantity error $f_k$. In the case of the ascertainment of injection quantity error $f_k$ according to FIG. 9, correction value $c_k$ results as the reciprocal value of injection quantity error $f_k$. After completion of adjustment operation 30, first air/fuel ratio $p_{1,k}$ is ascertained for cylinder k to be checked as a function of ascertained correction value $c_k$. Using correction value $c_k$ as the reciprocal value of injection quantity error $f_k$, the injection quantity for the first air/fuel ratio results from the product of correction value $c_k$ and the injection quantity of pre-calculated air/fuel ratio $p_{0,k}$.

If the diagnosis is carried out for a cylinder k to be checked, multiple correction values $c_k$ are ascertained for cylinder k to be checked. Correction value $c_k$ for cylinder k to be checked may be adapted as a function of previously ascertained correction values $c_k$. This adaptation may take place in the form of smoothing, for example. One example for the adaptation is shown in equation 1 below. An instantaneous adapted correction value $c_k$ (m+1) results according to equation 1 from the old, previously adapted correction value $c_k$ (m) and from correction value $c_{k,m}$ ascertained in the diagnosis carried out last. Correction value $c_{k,m}$ results directly from the reciprocal value of injection quantity error $f_k$ ascertained last. An adaptation factor $\alpha$ from equation 1 may be selected to be either fixed or flexible. In the flexible specific embodiment, adaptation factor $\alpha$ may, for example, have a low adaptation speed of $\alpha=0.2$, for example, in the case of a small gradient of the change in uneven running dlu. In the case of a large gradient of the change in uneven running dlu, however, it is possible to select a higher adaptation speed in the form of adaptation value $\alpha$ of $\alpha=0.7$, for example.

$$c_k(m+1)=c_k(m)+\alpha\cdot(c_{k,m}-c_k(m)) \quad (1)$$

In the case of fuel injection quantity errors $f_k<1$ and $f_k>0.85$, however, a lower adaptation speed, i.e., a lower adaptation value $\alpha$, is set. Due to the above-mentioned adaptation, an overshooting of the adaptation is prevented or reduced by correction factor $c_k$, thus making it possible to better comply with the target of lambda value of 1. In this way, the meaning of the change in uneven running dlu for lambda values of >1 is furthermore better accounted for.

The quality of correction value $c_i$ may be further improved when correction value $c_i$ is subsequently rejected after completion of the diagnosis if it is determined that one or multiple operating parameters has/have exceeded or fallen below certain limiting values during normal operation 28 and/or during adjustment operation 30, in particular when ascertaining first and/or second uneven running(s) lu28 and lu30. Also, correction value $c_i$ may be improved by terminating the diagnosis already during adjustment operation 30, for example, due to excessive changes of the operating parameters and by not ascertaining or further using any instantaneous value of correction value $c_i$.

Normal operation 28, adjustment operation 30, and the ascertainment of injection quantity error $f_i$ are carried out within the scope of the diagnosis for every cylinder 1, 2, 3, and 4 as cylinder k to be checked. For every cylinder i, a correction value $c_i$ is thus ascertained. According to below-mentioned equation 2, a balanced correction value $c_{i,e}$ for one cylinder i is ascertained from the product of particular correction value $c_i$ having the quotient from number n of cylinders i and the sum of all correction values $c_i$ for number n of cylinders i. In this way, it is achieved that, when using balanced correction value $c_{i,e}$ instead of correction value $c_i$, the fuel quantity to be injected into all cylinders i remains essentially constant.

$$c_{i,e} = c_i \cdot \frac{n}{\sum_{x=1}^{n} c_x} \tag{2}$$

Figure 8:
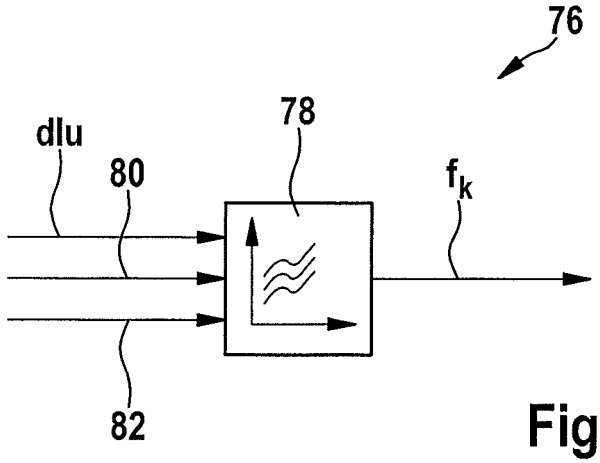
FIG. 8 shows a schematic block diagram of an alternative specific embodiment for ascertaining the injection quantity error.

FIG. 8 shows a schematic block diagram 76 of another specific embodiment for ascertaining injection quantity error $f_k$. Changes in uneven running dlu, a rotational speed 80 of internal combustion engine 6, as well as a load 82 of internal combustion engine 6 are supplied to an engine characteristic map 78. Injection quantity error $f_k$ is ascertained with the aid of engine characteristic map 78 as a function of the change in uneven running dlu, rotational speed 80, and load 82. Injection quantity error $f_k$ from FIG. 8 is used similarly to that in FIG. 7. An operating state is defined by rotational speed 80 of internal combustion engine 6 and load 82 of internal combustion engine 6. Multiple previously ascertained characteristic curves, such as characteristic curve 74 from FIG. 7, are present in the sense of engine characteristic map 78 for different operating states. As a function of the instantaneous operating state, one of the multiple characteristic curves is selected and/or linked and injection quantity error $f_k$ is ascertained for cylinder k to be checked with the aid of the selected characteristic curve as a function of the ascertained change in uneven running dlu.

Figure 9:
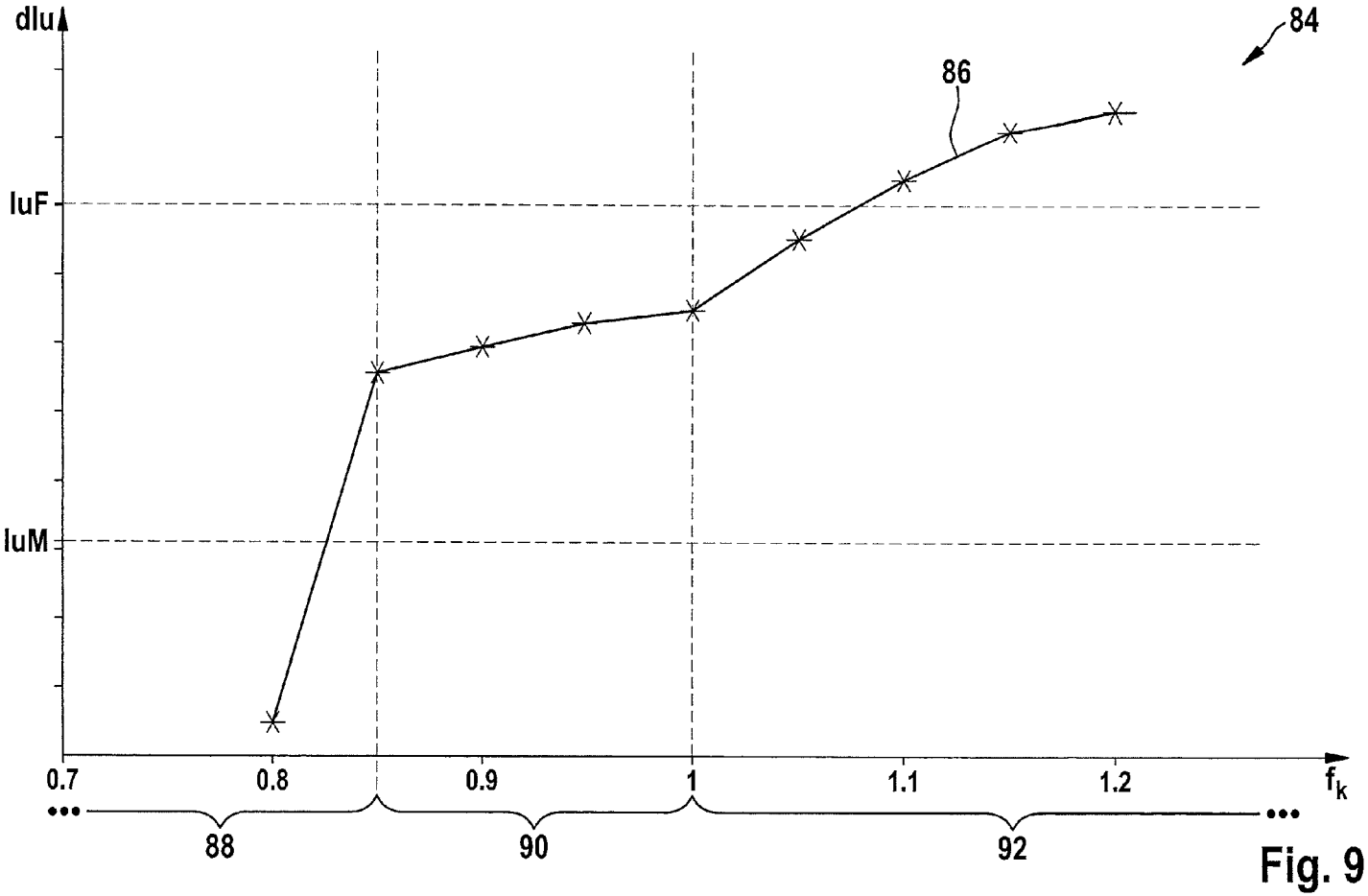
FIG. 9 shows a schematic injection quantity error-change in uneven running-diagram.

FIG. 9 shows a schematic injection quantity error-change in uneven running-diagram 84. Injection quantity error $f_k$ is plotted on the horizontal axis. The change in uneven running dlu is plotted along the vertical axis. A curve 86 was ascertained during the application phase and is used as characteristic curve 74 in FIG. 7 and as a characteristic curve in the engine characteristic map in FIG. 8. With the aid of curve 86, an injection quantity error $f_k$ may directly be deduced from an ascertained change in uneven running dlu. Alternatively to injection quantity error $f_k$, correction factor $c_k$ may of course also be plotted. Overall, curve 86 has a monotonically increasing characteristic with increasing injection quantity error $f_k$; this is why it is possible to unambiguously deduce injection quantity error $f_k$ from the predefined change in uneven running dlu.

The incorporation of correction factor $c_i$, $c_k$ or $c_r$ into predefined air/fuel ratio $p_i$, $p_k$ or $p_r$ corresponds to a trimming with regard to particular cylinder i, k or r. Injection quantity error $f_k$ having the values plotted in FIG. 9 corresponds to a factor with reference to the untrimmed case of cylinder k to be checked; here, value 1 for injection quantity error $f_k$ corresponds to the non-presence of an error with regard to the injection quantity, i.e., if the value for injection quantity error $f_k$ is 1, cylinder k to be checked essentially works properly with reference to the first air/fuel ratio. A first range 88 up to a value of injection quantity error $f_k$ of approximately 0.85 is plotted on the horizontal axis. A second range 90 extends from the value of injection quantity error $f_k$ of approximately 0.85 to approximately 1. A third range 92 extends approximately from value 1 for injection quantity error $f_k$ up to values greater than 1.

In second range 90, curve 86 has a smaller gradient as compared to ranges 88 and 92. To improve the ascertainment of injection quantity error $f_k$ and correction value $c_k$, air/fuel ratio $p_k$ correspondingly predefined for particular cylinder k is pre-enriched during normal operation 28 and adjustment operation 30, i.e., a pre-enrichment of air/fuel mixture $p_k$ takes place. In this context, pre-enrichment is understood to mean the increase of the fuel content of air/fuel mixture $p_k$ of cylinder k to be checked, thus increasing the susceptibility of the change in uneven running, so that an accurate correction and diagnosis may take place. This is achieved in that curve 86 is essentially shifted to the left with the aid of the pre-enrichment, thus resulting in a larger gradient in range 90.

A rich error threshold luF ascertained during the application phase and a lean error threshold luM ascertained during the application phase are assigned to curve 86. If, for example, a change in uneven running dlu is present which is greater than rich error threshold luF, a rich error is diagnosed. If a change in uneven running dlu is present which is smaller than lean error threshold luM, a lean error is present. Thus, an error is diagnosed for cylinder k to be checked when ascertained change in uneven running dlu is below lean error threshold luM or above rich error threshold luF. Similarly, corresponding rich error thresholds or lean error thresholds may of course be established for injection quantity error $f_k$ or correction value $c_k$, and an error may be similarly ascertained, it being possible to use advantageously averaged or adapted injection quantity errors $f_k$ or averaged or adapted correction values $c_k$ and thus to determine an error in a reliable manner.

Rich and lean error thresholds luF and luM are established during the application phase, taking into account the predefined exhaust gas threshold values; for this purpose, injection quantity error $f_k$ or the change in uneven running dlu is changed until an exhaust gas threshold value is reached, and the value ascertained last, e.g., injection quantity error $f_k$, is established as the error threshold, possibly with additional tolerance.

The above-described methods may be carried out as a computer program for a digital arithmetic unit. The digital arithmetic unit is suitable to carry out the above-described methods as a computer program. The internal combustion engine is in particular provided for a motor vehicle and includes a control unit which includes the digital arithmetic unit, in particular a microprocessor. The control unit includes a storage medium on which the computer program is stored.

What is claimed is:

1. A method for diagnosing an injection quantity error of at least one selected cylinder in an internal combustion engine having multiple cylinders, comprising:

predefining a respective first air/fuel ratio for each of the multiple cylinders during a normal operation;

ascertaining a first uneven running during the normal operation;

predefining, during an adjustment operation, a second air/fuel ratio for the selected cylinder for a predefined number of working cycles;

ascertaining a second uneven running during the adjustment operation; and ascertaining the injection quantity error for the selected cylinder as a function of the first uneven running and the second uneven running.

2. The method as recited in claim 1, wherein a change in uneven running is ascertained from the first uneven running and the second uneven running, and wherein the injection quantity error is ascertained for the selected cylinder as a function of the ascertained change in uneven running with the aid of a previously ascertained characteristic curve.

3. The method as recited in claim 2, wherein an error is diagnosed for the selected cylinder when the ascertained change in uneven running is one of (i) below a lean error threshold or (ii) above a rich error threshold.

4. The method as recited in claim 1, wherein the second air/fuel ratio is ascertained in an essentially fixed first ratio to the first air/fuel ratio, and wherein the second air/fuel ratio has a smaller fuel content than the first air/fuel ratio.

5. The method as recited in claim 4, wherein during the adjustment operation, a third air/fuel ratio is predefined for at least one other cylinder, the third air/fuel ratio being ascertained in an essentially fixed second ratio to the first air/fuel ratio for the at least one other cylinder, the third air/fuel ratio having a higher fuel content than the first air/fuel ratio for the at least one other cylinder.

6. The method as recited in claim 1, wherein during the adjustment operation, multiple uneven running values are ascertained within a time period of the predefined number of working cycles, and wherein the second uneven running is ascertained as an average value of the multiple uneven running values.

7. The method as recited in claim 1, wherein the ascertainment of injection quantity error is carried out for each one of the multiple cylinders.

8. The method as recited in claim 7, wherein:

a correction value is ascertained for each cylinder;

a balanced correction value is ascertained from the product of the correction value having the quotient from the number of the cylinders and the sum of all correction values for all cylinders; and the first air/fuel ratio is ascertained as a function of the balanced correction value.

9. The method as recited in claim 1, wherein:

an engine characteristic map having multiple previously ascertained characteristic curves is present for different operating states of the internal combustion engine, one of the operating states including a rotational speed of the internal combustion engine and a load of the internal combustion engine, and one of the multiple previously ascertained characteristic curves being selected as a function of the instantaneous operating state; and the injection quantity error is ascertained for the selected cylinder as a function of the ascertained change in uneven running with the aid of the selected characteristic curve.

10. The method as recited in claim 1, wherein a preenrichment of the air/fuel mixture takes place during the normal operation and the adjustment operation.

11. The method as recited in claim 1, wherein a correction value is ascertained for the selected cylinder as a function of the ascertained injection quantity error, and the first air/fuel ratio is ascertained for the selected cylinder as a function of the ascertained correction value.

12. The method as recited in claim 11, wherein the correction value for the selected cylinder is adapted as a function of a previously ascertained correction values for the selected cylinder.

13. The method as recited in claim 1, wherein the ascertaining of the first and second uneven runnings is of a crankshaft.

14. A non-transitory computer-readable data storage medium storing a computer program having program codes which, when executed on a computer, performs a method for diagnosing an injection quantity error of at least one selected cylinder in an internal combustion engine having multiple cylinders, the method comprising;

predefining a respective first air/fuel ratio for each of the multiple cylinders during a normal operation;

ascertaining a first uneven running during the normal operation;

predefining, during an adjustment operation, a second air/fuel ratio for the selected cylinder for a predefined number of working cycles;

ascertaining a second uneven running during the adjustment operation; and ascertaining the injection quantity error for the selected cylinder as a function of the first uneven running and the second uneven running.

15. Control unit for diagnosing an injection quantity error of at least one selected cylinder in an internal combustion engine having multiple cylinders, comprising:

means for predefining a respective first air/fuel ratio for each of the multiple cylinders during a normal operation;

means for ascertaining a first uneven running during the normal operation;

means for predefining, during an adjustment operation, a second air/fuel ratio for the selected cylinder for a predefined number of working cycles;

means for ascertaining a second uneven running during the adjustment operation; and means for ascertaining the injection quantity error for the selected cylinder as a function of the first uneven running and the second uneven running.

* * * * *